US007165306B2

(12) United States Patent
Bezek et al.

(10) Patent No.: US 7,165,306 B2
(45) Date of Patent: Jan. 23, 2007

(54) OVERCAP HAVING IMPROVED FIT

(75) Inventors: Edward Anthony Bezek, Frisco, TX (US); Aditya Varanasi, Plano, TX (US)

(73) Assignee: Frito-Lay North America, Inc., Plano, TX (US)

( * ) Notice: Subject to any disclaimer, the term of this patent is extended or adjusted under 35 U.S.C. 154(b) by 380 days.

(21) Appl. No.: 10/685,952

(22) Filed: Oct. 15, 2003

(65) Prior Publication Data

US 2005/0082304 A1 Apr. 21, 2005

(51) Int. Cl.
*B23P 11/02* (2006.01)
*B65D 41/16* (2006.01)

(52) U.S. Cl. ..... 29/453; 220/780

(58) Field of Classification Search ..... 29/453; 220/258.3, 780, 256.1; 215/317; 277/590, 277/644, 650
See application file for complete search history.

(56) References Cited

U.S. PATENT DOCUMENTS 2,780,259 A 2/1957 Nalle, Jr.
3,077,284 A * 2/1963 McLaughlin ..... 220/780
3,128,903 A 4/1964 Crisci
3,480,177 A 11/1969 Elliot
3,739,976 A 6/1973 Elliot
3,892,351 A 7/1975 Johnson et al.
3,927,820 A 12/1975 Wagner et al.
4,042,143 A 8/1977 Biggins
4,044,941 A 8/1977 Knudsen
4,059,181 A 11/1977 Greenfield, Jr. et al.
4,133,447 A 1/1979 Bouchet
4,154,360 A 5/1979 Smith
4,209,107 A * 6/1980 Crisci ..... 220/781
4,453,646 A 6/1984 Harrild
4,474,304 A 10/1984 Jacobs
4,500,010 A 2/1985 Schutz
4,504,009 A 3/1985 Boik et al.
4,691,501 A * 9/1987 King ..... 53/485
4,738,373 A 4/1988 DeParales
4,856,674 A 8/1989 Berney
5,127,523 A 7/1992 Herdlicka
5,592,766 A * 1/1997 Mygatt ..... 40/307

(Continued)

OTHER PUBLICATIONS

Craftech Industries, Inc. (http://web.archinve.org/web/20010211205117/http://www.craftechind.com/material.htm).*
Injection Molding Handbook, Third Edition; Kluwer Academic Publishers, copyright 2000, p. 1277.*

*Primary Examiner*—Essama Omgba
(74) *Attorney, Agent, or Firm*—Cartens & Cahoon, LLP; Colin P. Cahoon; Chad E. Walter

(57) ABSTRACT

The combination of an injection-molded, snap-on cap and a blow-molded, plastic container are designed to act together to provide a seal that prevents a loss of freshness to the porous product stored within, regardless of variations in the manufacturing process. Instead of a rounded ridge on the container, the ridge has a flattened section on its lower half. On the inside of the snap-on cap, the ridge has two flat surfaces. A first flat surface is designed to fit snugly against the flat surface on the ridge of the container, even at the extreme range of small container/large cap. The design has been shown to dramatically reduce the absorption of moisture by an enclosed product, demonstrating that a desirable seal is formed.

13 Claims, 4 Drawing Sheets

U.S. PATENT DOCUMENTS 5,779,086 A 7/1998 Barrash
5,860,549 A 1/1999 Allers et al.
5,950,638 A 9/1999 Crosta
6,047,851 A * 4/2000 Freek et al. ..... 220/780
6,116,453 A 9/2000 Przytulla
6,179,158 B1 1/2001 Koda
6,196,451 B1 3/2001 Helms
6,237,791 B1 5/2001 Beck et al.
6,544,613 B1 4/2003 Varadarajan
6,547,093 B1 4/2003 Archibald et al.

* cited by examiner

FIG. 1A
(PRIOR ART)
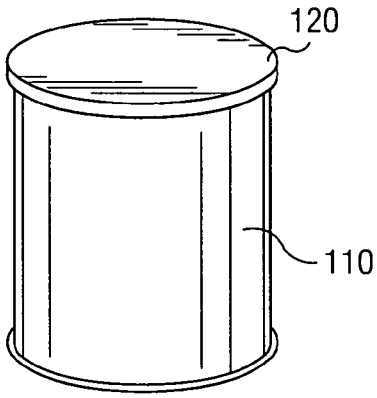
FIG. 1B
(PRIOR ART)
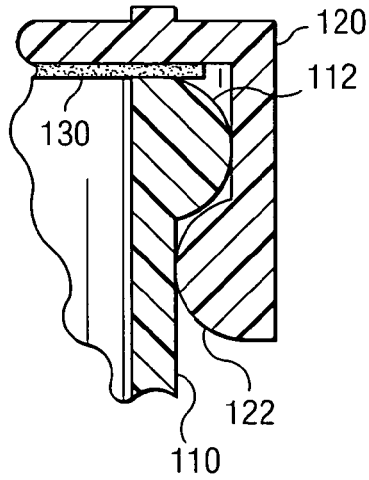
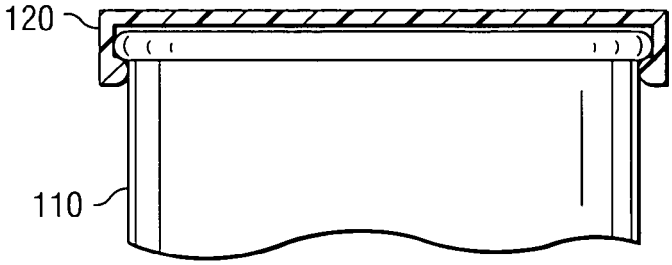
FIG. 2A
(PRIOR ART)
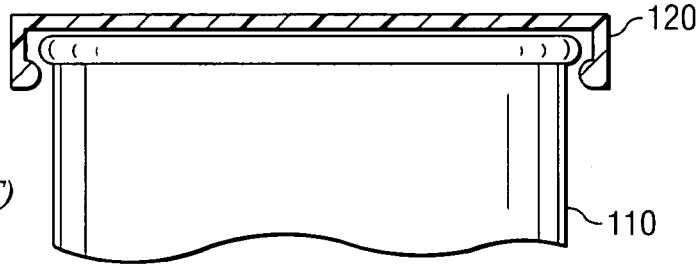
FIG. 2B
(PRIOR ART)
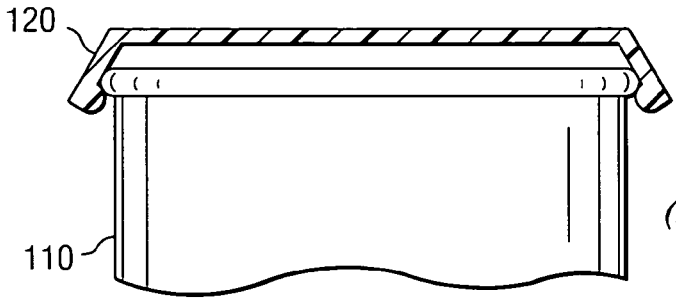
FIG. 2C
(PRIOR ART)

OVERCAP HAVING IMPROVED FIT

BACKGROUND OF THE INVENTION

1. Technical Field

The invention relates generally to providing a combination of cap and plastic container that provides a snug fit while remaining easily removable. More specifically, the invention relates to providing an inexpensive, injection molded cap for an inexpensive, blow molded container that nevertheless provides a good seal.

2. Related Art

In offering food products to the consumer, convenience and cost are two considerations that receive a lot of attention. This applies not only to the food product itself, but also to the packaging in which it is marketed. The vast majority of products are either wrapped in a plastic film or provided in a disposable container. If the product is packaged in a quantity greater than a single serving, there may be both an original seal, designed to seal in freshness and offer evidence of tampering, as well as an overcap used to re-close the package between uses.

Thin, plastic snap-on caps are often used to provide closure for disposable food containers once a sealing closure has been removed. FIG. 1 shows a perspective of a prior art container 110 and overcap 120 that can be used for food items. When the product is initially placed in the container 110, a freshness seal 130 is placed over the opening to the container 110 and fixed there, such as by an adhesive. An overcap 120 is then placed on the container 110 over the freshness seal 130. When the consumer is ready to consume the product, they will remove both the overcap 120 and freshness seal 130 to consume the product. The freshness seal 130 will be disposed of, but the overcap 120 is typically retained to provide a closure to protect remaining product.

Injection molding can be used to make the overcaps inexpensively. Examples of containers on which these are used include paperboard containers having a plastic or metal rim (used, for example, with oatmeal or roasted nuts) and plastic tubs (for soft cheeses and butter). Typically, the overcap 120 has a rounded ridge 122 on the inside, which snaps over a similar ridge 112 on the container 110. In some cases, the fit of the cap to the container is not a prime concern, as the product does not quickly stale, such as with butter. When maintaining freshness is important, such as with products that stale quickly, a tight seal of overcap to container is desirable. In these applications, the container is typically made of a heavier material, such as paperboard, and often the rim of the container is made of a material, such as a metal, for which the manufacturing tolerances are small. The downside of this approach is the cost, as these techniques are more expensive than molded plastic.

Blow molding is a commonly used technique for forming thin-walled plastic containers. In one version of this molding technique, a thick-walled tube of plastic (shaped similarly to a test tube) is first heated and placed inside a mold. The tube is then inflated by injecting air into it, so that the tube expands to fit the inside of the mold. The mold is chilled to cool the plastic quickly. Blow molding techniques have made inexpensive containers possible, although it is not possible to meet tight tolerances with just blow molding. When a blow-molded bottle needs a tight lid, e.g., for soft drinks, the neck of the bottle is formed by another technique, allowing a tighter fit to the lid.

Because blow molding a container and injection molding a snap-on cap are inexpensive methods of producing a lidded container, it would be desirable to manufacture a lidded container by these processes. However, it is difficult to produce an injection molded snap-on cap to fit the variations that can be produced by blow molding a container. FIG. 2*a* shows a prior art combination as it is designed to fit. FIG. 2*b* demonstrates the problem of a loose fit when injection molded cap 220 is at the large end of its tolerance and the blow molded container 210 is at the small end of its tolerance. In this case, the cap can be easily pushed off, even by excess pressure within the container. FIG. 2*c* demonstrates the problem at the other extreme of the fit spectrum, where the injection molded cap 220 is at the small end of its tolerance and the blow-molded container 210 is at the large end of its tolerance. In this instance, the cap can fit so snugly that it is difficult to remove. Additionally, there is commonly only a single point of contact between the container and cap when viewed in cross-section. This does not provide the seal that is necessary when the product degrades under prolonged exposure to the air.

Of course, many different shapes of lid and containers are possible. For instance, FIGS. 3*a* and 3*b* demonstrate a number of prior art lids and their ideal fit to a corresponding container. FIG. 3*a* is taken from U.S. Pat. No. 6,047,851 to Freck et al. Freck's container has a rounded edge to act in place of a rounded bead and the patent is directed to modifying that edge from a prior art shape to better allow the cap to be removed without cracking. The cap of Freck is apparently intended to fit snugly against the container across most of the rim of the container. FIG. 3*b* is taken from U.S. Pat. No. 3,892,351 to Johnson et al. The tubular container is a glue-bonded, paperboard composite, spirally wound tube, with its top rim rolled outwardly to form a circumferentially extending bead. The overcap has a radially inwardly and downwardly extending shoulder that engages with the rolled rim of the container.

In order to provide an inexpensive method of packaging snack foods, it would be desirable to design a better snap-on overcap that can be used with a blow-molded container in order to provide packaging for a snack product. Since packaging for such a product is considered a disposable, it is desirable to keep the costs of such a combination container/overcap low. At the same time, although it is not necessary for the overcap to protect the product during shipping, it should be sufficiently well fitting that the product remaining after an initial opening of the container can be protected from absorbing too much moisture, which can cause degradation of the product.

SUMMARY OF THE INVENTION

The invention discloses a combination of a snap-on overcap and a blow-molded plastic container that are designed to act together to provide a reclosable seal after removal on the original freshness seal. This reclosable seal is designed to prevent a loss of freshness to the porous product stored within, regardless of variations in the manufacturing process. Instead of a rounded ridge on the container, the ridge has a flattened section on its lower half. On the inside of the snap-on cap, the ridge has two flat surfaces. The upper flat surface is designed to fit snugly against the flat surface on the ridge of the container, even at the extreme range of small container/large cap. Interferences between the container and cap at points other than the intended flat surfaces can cause the closure to become point-to-point, rather than the desired surface-to-surface, so other portions of the inside of the cap are designed to not touch the container, preventing interferences. The design has been shown to dramatically reduce the absorption of moisture by an enclosed product, demonstrating that a desirable seal is formed.

BRIEF DESCRIPTION OF THE DRAWINGS

The invention as well as a preferred mode of use, further objectives and advantages thereof, will be best understood by reference to the following detailed description of illustrative embodiments when read in conjunction with the accompanying drawings, wherein:

FIG. 1 shows a perspective of a prior art container, freshness liner, and overcap.

FIG. 2*a* shows an overcap having an ideal fit to the container.

FIGS. 2*b* and 2*c* show an overcap having respectively a very loose and a very tight fit to the container.

DETAILED DESCRIPTION

Figure 3A:
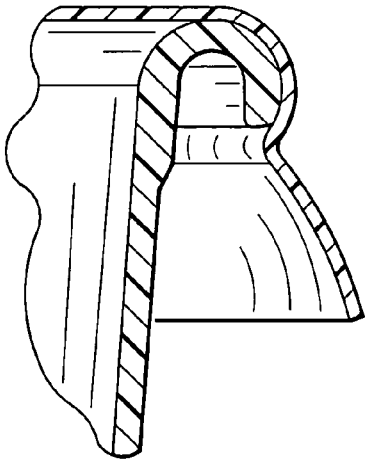
FIG. 3A (PRIOR ART)
FIGS. 3*a* and 3*b* show prior art containers with lids or overcaps.
Figure 3B:
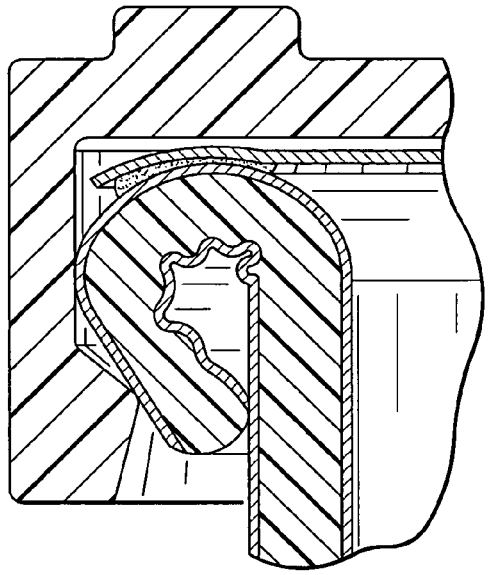
FIG. 3B (PRIOR ART)
Figure 4A:
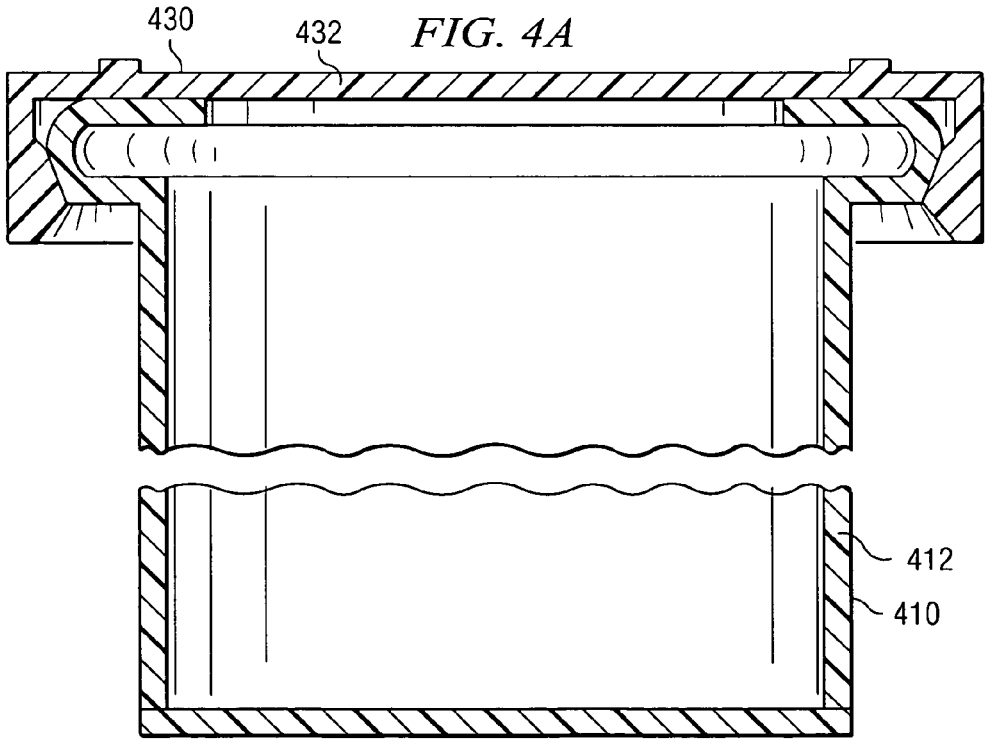
FIGS. 4*a*, 4*b*, and 4*c* show an embodiment of the innovative container and overcap.
Figure 4B:
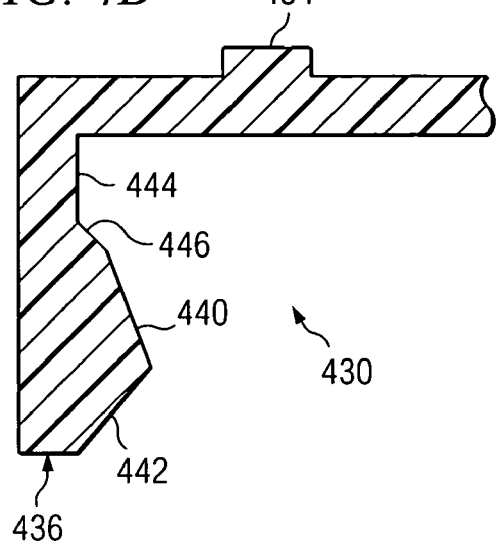
Figure 4C:
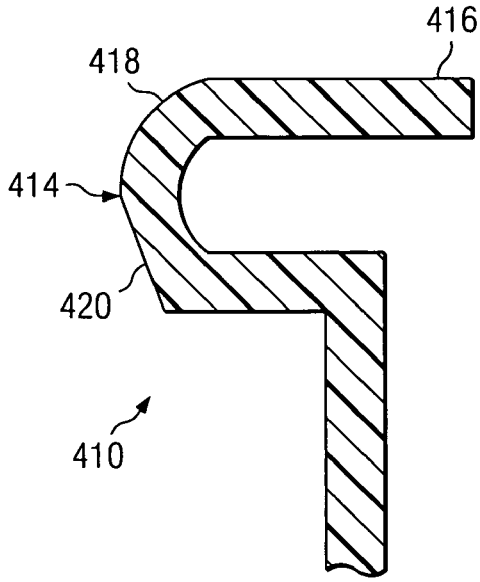
Figure 5:
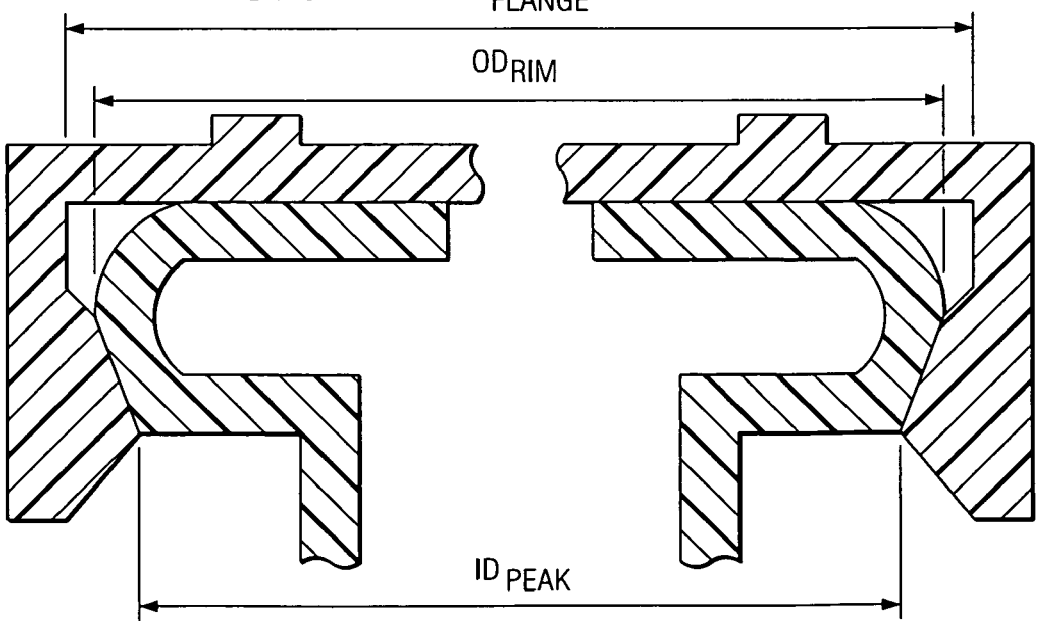
FIG. 5 show measurements of the container and overcap that are important to the fit.

An embodiment of the innovative invention will now be described with reference to FIGS. 4A–C. FIG. 4A shows a slice taken through a container 410 and overcap 430 after removal of the freshness liner, according to an exemplary embodiment of the invention. FIGS. 4B and 4C demonstrate the different parts of the cap 430 and container 410 respectively. Container 410 was designed to hold a formed, stacked potato chip product and is preferably formed by blow molding of a high-density, low friction, polyethylene. The container has a wide-mouth opening, surrounded by a rim 414 onto which the cap 430 can be snapped. The body 412 of the container 410 can vary in cross-section and may, for example, have an oval shape, although the area near to and including the rim 414 is preferably circular. The topmost portion of rim 414 extends inward toward the opening to form a flat surface 416. A rounded corner 418 on the rim 414 allows the cap 430 to slip on to the container 410 easily, while a downwardly facing, flattened surface 420 provides a first sealing surface. When the container is originally filled, a thin, flexible seal (not shown) is applied to the flat surface 416 surrounding the opening, as is well known in the art. Overcap 430 is then placed over the container 410 and flexible seal, but does not initially provide any sealing. The overcap 430 is intended for use after the consumer has unsealed the container, but has not yet finished the contents. At that time, the cap 430 can be replaced on the container 410 as shown in FIG. 4A.

Overcap 430 is injection molded, using a low-density polyethylene. The cap has a generally flat upper surface 432, with a ridge 434 running near the outer edge to provide additional strength. A flange 436 extends generally perpendicularly to the upper surface 432, but preferably "toes inwardly" about 3 degrees. On the inside of the flange 436, a raised ridge has upper- and lower-facing flat surfaces 440, 442. Surface 440 of cap 430 and surface 420 of container 410 are designed to mate with each other, forming a sealing surface, rather than a point-to-point seal as in the past. The cap must be sized so that the surface 440 of the cap will extend against the surface 420 of the container, even at the extreme range of small container/large cap. Additionally, interferences at other points between the container and cap can cause the closure to become point-to-point, rather than the desired surface-to-surface. The design must be adjusted so that surfaces 442 and 444 on the inside of flange 436 never cause interference with the container, even at the extreme range of large container/small cap. Note also that surface 446 is not a continuation of sealing surface 440, but angles away from the container to prevent interference here. The calculations necessary to ensure a proper fit are explained below.

The calculations necessarily start with the nominal, or designed, greatest diameter of the container rim, along with the manufacturing tolerance for the container $T_{CNTR}$ and the manufacturing tolerance for the cap $T_{CAP}$. These numbers will be used to determine two design measurements of the overcap. The measurements are shown graphically in FIG. 4. $OD_{RIM}$ is the outside diameter of the rim of the container at its greatest diameter. $ID_{PEAK}$ is the inside diameter of the overcap at the peak of the ridge, while $ID_{FLANGE}$ is the inside diameter of the overcap at a point just above the ridge. Because of the tolerances, we will identify these measurements as, for example, $OD_{RIM.NOM}$ for the nominal measurement of $OD_{RIM}$, $OD_{RIM+}$ for the largest value of $OD_{RIM}$, and $OD_{RIM-}$ for the smallest value of $OD_{RIM}$. In this example, we are starting with a nominal value, $OD_{RIM.NOM}$=3.128 inches (79.44 mm). The blow-molded container has a tolerance $T_{CNTR}$=+/−0.015 inches (+/−0.381 mm), while the lid can be made to tighter tolerance $T_{CAP}$=+/−0.007 inches (+/−0.178 mm). For the container, this means that $OD_{RIM-}$=3.128−0.015 inches, or 3.113 inches (79.44−0.381 mm=79.059 mm), while $OD_{RIM+}$=3.128+0.015 inches=3.143 inches (79.44+0.381 mm=79.821 mm).

The inventors determined experimentally that for the tightness they wished to achieve with the overcap, $OD_{RIM}$ and $ID_{PEAK}$ should have an overlap OVR=0.015 inches (0.381 mm) on each side, so that in cross-section there is a total of 0.030 inches (0.762 mm) difference in these two measurements. This figure should be achievable with the smallest container and the largest overcap, the combination most likely to have too loose a lid. As we determined above, the smallest container that meets the tolerance will have a value of $OD_{RIM}$=3.113 in. (79.059 mm). Therefore; $ID_{PEAK+}$, the value on the largest container, should equal $OD_{RIM-}$−(2·OVR), or 3.113−0.030=3.083 inches (79.059−0.762=78.297). Since this is the largest value, $ID_{PEAK+}$, $ID_{PEAK.NOM}=ID_{PEAK+}-T_{CAP}$=3.083−0.007=3.076 inches (78.297−0.178=78.119 mm). Thus, the formula $ID_{PEAK.NOM}=((OD_{RIM.NOM}+T_{CNTR})-(2\cdot OVR))-T_{CAP}$ will assure at least an overlap of OVR in the worst-case scenario. Of course, one of ordinary skill in the art will recognize that the amount of desired overlap can be increased or decreased, depending on the desired fit.

To avoid interference in a large container with small overcap combination, it is necessary that $ID_{FLANGE-}$ is never smaller than $OD_{RIM+}$. $OD_{RIM+}$ is 3.143 inches (79.832 mm). This means that $ID_{FLANGE-}$ should be at least 3.143 inches (79.832 mm). Given the tolerance of 0.007 inches (0.178 mm) inches for the overcap, the value for $ID_{FLANGE.NOM}=ID_{FLANGE-}+T_{CAP}$=3.143+0.007 inches=3.150 inches (79.832+0.178=80.010 mm). The final formula for calculating clearance is $ID_{FLANGE.NOM} \geqq OD_{RIM.NOM}-T_{CNTR}+T_{CAP}$.

We now have nominal values for the three measurements shown. Table 1 below shows the range of sizes that these dimensions can take, given the tolerances.

TABLE 1

Dimensions of Container, Overcap

| | Nominal size | Range of tolerance | Smallest diameter | Largest diameter |
|---|---|---|---|---|
| $OD_{RIM}$ | 3.128 in. (79.451 mm) | +/−0.015 in. (+/−0.381 mm) | 3.113 in. (79.070 mm) | 3.143 in. (79.832 mm) |
| $ID_{FLANGE}$ | 3.150 in. (80.010 mm) | +/−0.007 in. (+/−0.178 mm) | 3.143 in. (79.832 mm) | 3.157 in. (80.188 mm) |
| $ID_{PEAK}$ | 3.076 in. (78.130 mm) | +/−0.007 in. (+/−0.178 mm) | 3.069 in (77.953 mm) | 3.083 in. (78.308 mm) |

The space between the container and the overcap, $OD_{RIM}$–$ID_{FLANGE}$, are shown for various points with the allowed tolerance in Table 2 below. As this table shows, the space between the container and overcap will go to zero only in the single scenario of the largest container and smallest cap. Of course, this is a minimum value of $ID_{FLANGE}$; any increase in $ID_{FLANGE}$ will increase the clearance so that there is always space. After determining this value, the inventors then worked with cutouts of the container and overcap to see the areas where interference was most likely. After their tests, they relieved the portion of surface 440 that is closest to the base of the overcap, forming surface 446.

TABLE 2

Clearance between Container Rim and Overcap ($OD_{RIM}$ - $ID_{FLANGE}$)

| | Nominal Bottle | Small Bottle | Large Bottle |
|---|---|---|---|
| Nominal Cap | 0.022 in. (0.559 mm) | 0.037 in. (0.940 mm) | 0.007 in. (0.178 mm) |
| Small Cap | 0.015 in. (0.381 mm) | 0.030 in. (0.762 mm) | 0.000 in. (0.000 mm) |
| Large Cap | 0.029 in. (0.737 mm) | 0.044 in. (1.118 mm) | 0.014 in. (0.356 mm) |

Similarly, the amount of overlap ($OD_{RIM}$–$ID_{PEAK}$) in the various sizes of containers and overcaps is shown in Table 3, where it is clear that there is always sufficient overlap to maintain the desired seal.

TABLE 3

Overlap of Overcap and Rim of Container ($OD_{RIM}$ - $ID_{PEAK}$)

| | Nominal Bottle | Small Bottle | Large Bottle |
|---|---|---|---|
| Nominal Cap | 0.052 in. (1.321 mm) | 0.037 in. (0.940 mm) | 0.067 in. (1.702 mm) |
| Small Cap | 0.059 in. (1.499 mm) | 0.044 in. (1.118 mm) | 0.074 in. (1.880 mm) |
| Large Cap | 0.045 in. (1.143 mm) | 0.030 in. (0.762 mm) | 0.060 in. (1.524 mm) |

It is desirable to have a slight "toe-in" of the flange with the base of the overcap, rather than a ninety-degree angle. Preferably, the angle made by the flange and the base on the inside of the overcap is about 87° or about three degrees of toe-in. The toe-in can be achieved by one of two methods, depending on the manufacturer's preference. It is known that plastics will shrink as they cool, and the hotter they are when taken out of the mold, the more they will shrink. In one embodiment, the toe-in can be achieved by molding the overcap with a 90° angle between the base and flange, then remove the overcap from the mold at a point that will cause enough shrinkage to create the 3° toe-in. Alternatively, the overcap can be cast so that it is made with a 3° toe-in, then allowed to remain in the mold until cool enough that the angle will not change.

Test Results

Figure 6:
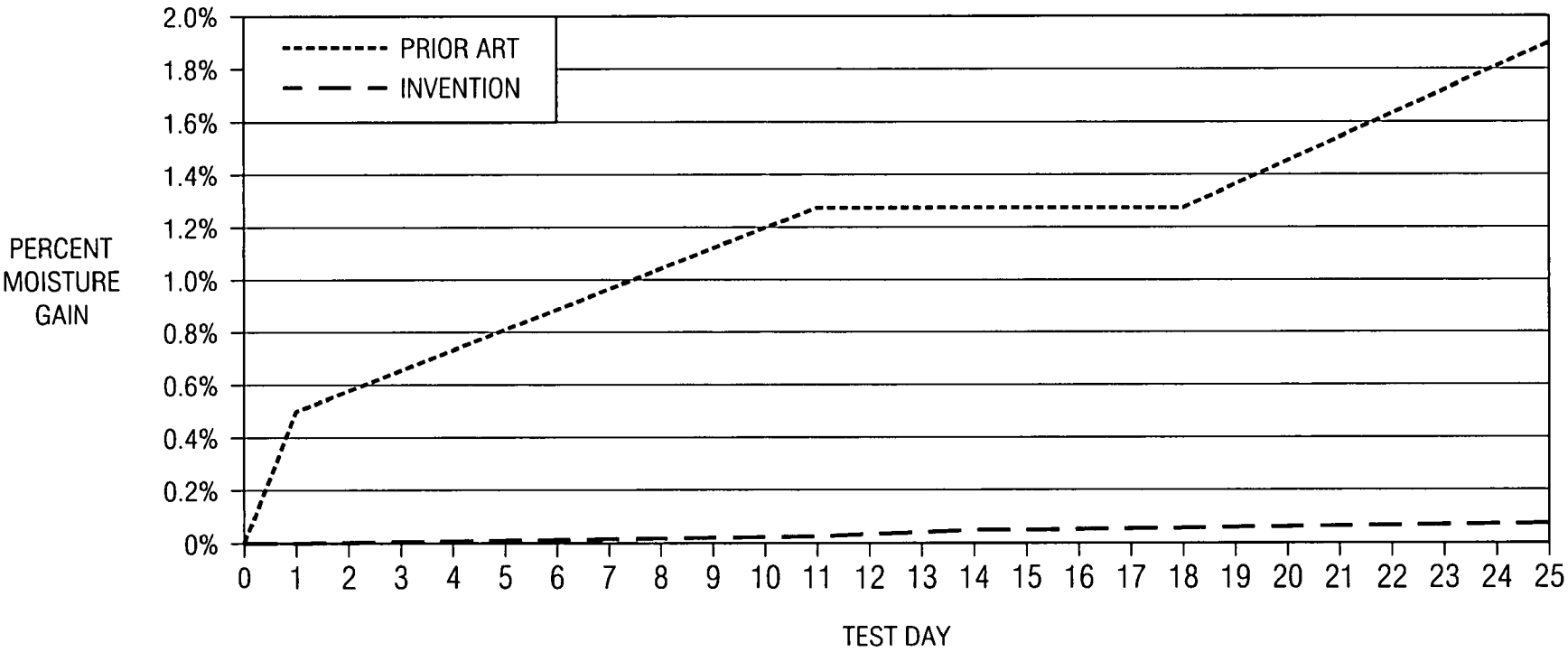
FIG. 6 shows a graph of moisture absorption by a porous product that is packaged in a prior art container/overcap combination and an embodiment of the inventive container/overcap.

FIG. 6 discloses the results of a test that monitored the absorption of moisture between a porous snack product packaged in the disclosed container and overcap and a similar product packed in a competitor's package, which is made of a metalized cardboard that has been given a rolled rim. The packaged products were tested over a twenty-five day period. The innovative container/overcap fit was able to maintain freshness much better than the competitor's fit of overcap to rolled cardboard. As this chart shows, the innovative container/overcap combination showed less than $1/10^{th}$ of one percent of moisture absorption over 25 days, while the prior container/overcap showed moisture absorption of about 1.9 percent over the same 25 days. This can make a huge difference in the consumer satisfaction in the keeping power of the product.

In summary, the disclosed combination of container and overcap, even though made by different processes with a relatively large variability in the container can still provide a well-fitting lid at low costs. The seal has been designed to be surface-to-surface, rather than point-to-point and the overcap has been designed to maintain this relationship.

What is claimed is:

1. A method of providing a close fit between a molded container and a molded overcap, where the overcap has a smaller amount of tolerance in the molding process than does the container, the method comprising the steps of:

(a) providing a container, such that said container has an opening surrounded by a rim, said rim having an upper portion that is rounded and a lower portion that is flat in cross-section, wherein said container comprises a nominal outer diameter at a largest circumference of said rim of $OD_{RIM.NOM}$ with a manufacturing tolerance of $T_{CNTR}$;

(b) providing a snap-on overcap to removably snap over said rim of said container, wherein a base of said overcap is sized to cover said opening, said overcap further comprising a flange with an outer surface extending essentially perpendicularly from said base, an inner surface of said flange comprising an essentially perpendicular portion extending from the base, a circumferential ridge adjacent the essentially perpendicular portion, said circumferential ridge having a peak defining a flattened upper and lower faces, said flattened upper face being configured to seat against said rim flat lower portion such that the only contact between said rim and said flange takes place between said flattened upper face and said rim flat lower portion, wherein further said flattened upper face comprises an adjacent upper surface, wherein said adjacent upper surface and said flattened lower face angle away from said container, said overcap having a manufacturing tolerance of $T_{CAP}$, wherein $T_{CAP}<T_{CNTR}$.

2. The method of claim 1, wherein both of said container and said overcap are molded.

3. The method of claim 1, wherein said container is blow molded.

4. The method of claim 1, wherein said overcap is injection molded.

5. The method of claim 1, wherein said lower portion of said rim and said face of said ridge provide a surface-to-surface contact.

6. The method of claim 1, wherein a nominal inner diameter of said overcap at said peak is equal to the nominal outer diameter of said rim of said container plus the manufacturing tolerance of said container minus twice an overlap needed for tightness minus the manufacturing tolerance of said overcap ($ID_{PEAK.NOM}=OD_{RIM.NOM}+T_{CNTR}-(2\times OVR)-T_{CAP}$).

7. The method of claim 1, wherein a nominal inner diameter of said overcap at locations away from said ridge is greater than a nominal outside diameter of the rim of said container at a largest diameter minus the manufacturing tolerance of said container plus the manufacturing tolerance of said overcap.

8. The method of claim 1, wherein said container comprises a high-density polyethylene.

9. The method of claim 1, wherein said overcap comprises a low-density polyethylene.

10. The method of claim 1, wherein said container and said overcap each comprises a low friction plastic.

11. A method of providing a close fit between a molded container and a molded overcap, where the overcap has a smaller amount of tolerance in the molding process than does the container, the method comprising the steps of:

(a) providing a container, such that said container has an opening surrounded by a rim, said rim having an upper portion that is rounded and a lower portion that is flat in cross-section, wherein said container comprises a nominal outer diameter at a largest circumference of said rim of $OD_{RIM.NOM}$ with a manufacturing tolerance of $T_{CNTR}$;

(b) providing a snap-on overcap to removably snap over said rim of said container, wherein a base of said overcap is sized to cover said opening, said overcap further comprising a flange extending essentially perpendicularly from said base, an inner surface of said flange containing a circumferential ridge having a peak, a flattened face of said ridge being configured to seat against said lower portion of said rim of said container, said overcap having a manufacturing tolerance of $T_{CAP}$, wherein $T_{CAP}<T_{CNTR}$., said providing step (b) comprising (b1) determining a desired overlap between said peak and said rim of OVR to provide a desired tightness in the fit;

(b2) determining a nominal inner diameter of said cap at said peak to be $ID_{PEAK.NOM}=OD_{RIM.NOM}+T_{CNTR}-(2\times OVR)-T_{CAP}$; and (b3) determining a nominal inner diameter of said cap at locations away from said ridge to be $ID_{FLANGE.NOM}>OD_{RIM.NOM}-T_{CNTR}+T_{CAP}$.

12. The method of claim 11, wherein said container is blow molded.

13. The method of claim 11, wherein said overcap is injection molded.

* * * * *

UNITED STATES PATENT AND TRADEMARK OFFICE

CERTIFICATE OF CORRECTION

PATENT NO. : 7,165,306 B2
APPLICATION NO. : 10/685952
DATED : January 23, 2007
INVENTOR(S) : Edward Anthony Bezek and Aditya Varanasi It is certified that error appears in the above-identified patent and that said Letters Patent is hereby corrected as shown below:

Claim 1, Column 7, line 3, please delete the word " a "

so that line 3 correctly reads:

--peak defining flattened upper and lower faces, said--

Signed and Sealed this

Third Day of April, 2007

JON W. DUDAS
*Director of the United States Patent and Trademark Office*